US011317667B2

(12) United States Patent
Pilosi et al.

(10) Patent No.: US 11,317,667 B2
(45) Date of Patent: May 3, 2022

(54) METHOD OF ATTACHING EXTENSIONS

(71) Applicant: Specialty Commerce Corporation, West Bridgewater, MA (US)

(72) Inventors: Gail Pilosi, Nahant, MA (US); Michael Ippolito, Garden City, NY (US); Emma Slater, West Bridgewater, MA (US)

(73) Assignee: SPECIALTY COMMERCE CORPORATION, West Bridgewater, MA (US)

( * ) Notice: Subject to any disclaimer, the term of this patent is extended or adjusted under 35 U.S.C. 154(b) by 324 days.

(21) Appl. No.: 16/431,840

(22) Filed: Jun. 5, 2019

(65) Prior Publication Data

US 2020/0383412 A1 Dec. 10, 2020

(51) Int. Cl.
*A41G 5/00* (2006.01)

(52) U.S. Cl.
CPC ..... *A41G 5/006* (2013.01); *A41G 5/0073* (2013.01)

(58) Field of Classification Search
CPC ..... A45G 5/00; A45G 5/0006; A45G 5/0013; A45G 5/002; A45G 5/0026; A45G 5/004; A45G 5/006; A45G 5/0073; A45G 5/0066; A45G 5/0093; A45G 5/0046; A41G 3/00; A41G 3/0008; A41G 3/0041; A41G 3/005; A41G 5/00; A41G 5/0006; A41G 5/0013; A41G 5/002; A41G 5/0026; A41G 5/004; A41G 5/006; A41G 5/0073; A41G 5/0066; A41G 5/0093; A41G 5/0046; A45D 19/0041
See application file for complete search history.

(56) References Cited

U.S. PATENT DOCUMENTS

| | | | | |
|---|---|---|---|---|
| 3,678,942 | A | 7/1972 | Abbott et al. | |
| 4,386,619 | A * | 6/1983 | Williams | A41G 3/00 132/53 |
| 5,979,462 | A * | 11/1999 | Jones | A41G 3/005 132/201 |
| 7,861,729 | B2 * | 1/2011 | Zephyr | A41G 3/0041 132/53 |
| 2004/0168696 | A1 * | 9/2004 | Cox | A41G 3/0041 132/54 |
| 2005/0051186 | A1 * | 3/2005 | Smith | A41G 3/0058 132/54 |
| 2007/0251536 | A1 * | 11/2007 | Kupitz | A41G 3/00 132/53 |

(Continued)

OTHER PUBLICATIONS

International Search Report and Written Opinion in corresponding application No. PCT/US2020/036071 dated Aug. 18, 2020.

*Primary Examiner* — Rachel R Steitz
*Assistant Examiner* — Karim Asqiriba
(74) *Attorney, Agent, or Firm* — Burns & Levinson, LLP; Joseph P. Quinn

(57) ABSTRACT

A method of attaching hair extensions to hair on a user's head includes attached a first plurality of wefts to hair in an upper section on a first horizontal side of a user's head. A second plurality of wefts is attached to hair in the upper section on a second side horizontal side of the user's head. A third plurality of wefts is attached to hair in the lower section on both the first side and the second side of the user's head. The wefts are of varying lengths and include extension hair of varying lengths.

14 Claims, 4 Drawing Sheets

(56) References Cited

U.S. PATENT DOCUMENTS

| | | | | |
|---|---|---|---|---|
| 2008/0110472 | A1* | 5/2008 | Kaweblum | A41G 5/0026 132/276 |
| 2013/0133680 | A1 | 5/2013 | Wang | |
| 2014/0299145 | A1* | 10/2014 | Chira | A41G 3/005 132/53 |
| 2016/0015107 | A1* | 1/2016 | Sehovic | A41G 5/0073 132/201 |
| 2016/0324239 | A1* | 11/2016 | Kim | A41G 5/004 |

* cited by examiner

METHOD OF ATTACHING EXTENSIONS

FIELD OF THE TECHNOLOGY

The subject disclosure relates to hair extensions and methods of attaching hair extensions to a user's head.

BACKGROUND OF THE TECHNOLOGY

Hair extensions are used by individuals to supplement their own natural hair. Hair extensions typically include extension hair attached to a weft, as well as some attachment mechanism for attaching the weft to the user's natural hair (e.g. clips). The wefts are often attached directly to the natural hair of the user. While hair extensions are meant to look like real hair, many hair extension kits, and the methods of attaching same, are difficult to attach and/or fail to achieve a natural look.

SUMMARY OF THE TECHNOLOGY

In light of the needs described above, in at least one aspect, the subject technology relates to a method of hair extension weft attachment to a user's head which is simple and provides a full and natural look, blending with the user's hair. Weft length and placement, as well as the length of extension hair corresponding to each weft, are modified, in accordance with the subject technology, to provide a graduated arrangement of the extension hair that blends with the natural hair of the user.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 2:
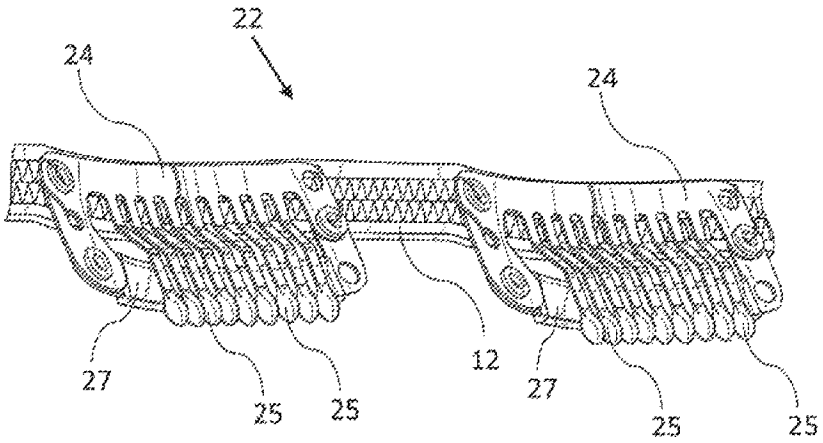
FIG. 2 is a rear perspective view of an exemplary weft and clips for a hair extension in accordance with the subject technology.

The subject technology overcomes many of the prior art problems associated with hair extensions and hair extension placement on a head. In brief summary, the subject technology provides a method of attaching hair extensions to a head that results in a natural, full look. The advantages, and other features of the systems and methods disclosed herein, will become more readily apparent to those having ordinary skill in the art from the following detailed description of certain preferred embodiments taken in conjunction with the drawings which set forth representative embodiments of the present invention. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

For ease of explanation, the user's head is described herein as divided into various portions, sections, and/or the like. These descriptions are merely provided to facilitate describing the placement of extensions and other features of the subject technology. Therefore nothing about the portions or sections of the user's head itself should be construed as limiting implementation of the subject technology to a particular kind of user or head. Further, parts are numbered arbitrarily throughout for ease of reference, often in the order they are introduced. In different arrangements or explanations, different parts could have different numbers.

Figure 1:
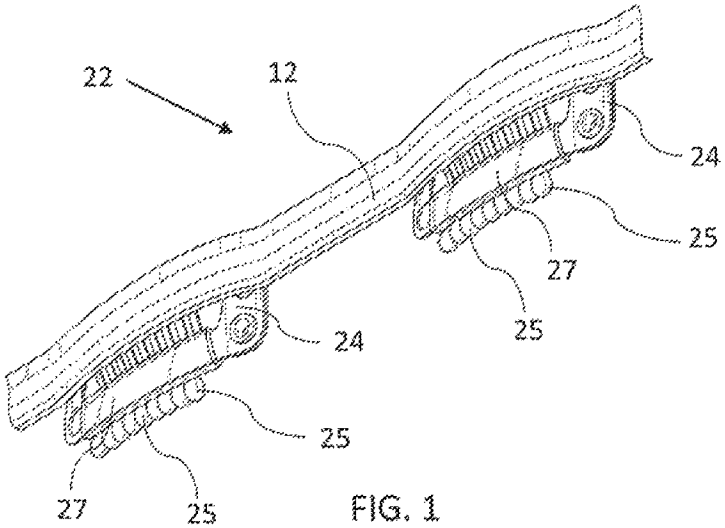
FIG. 1 is a front perspective view of an exemplary weft and clips for a hair extension in accordance with the subject technology.
Figure 3:
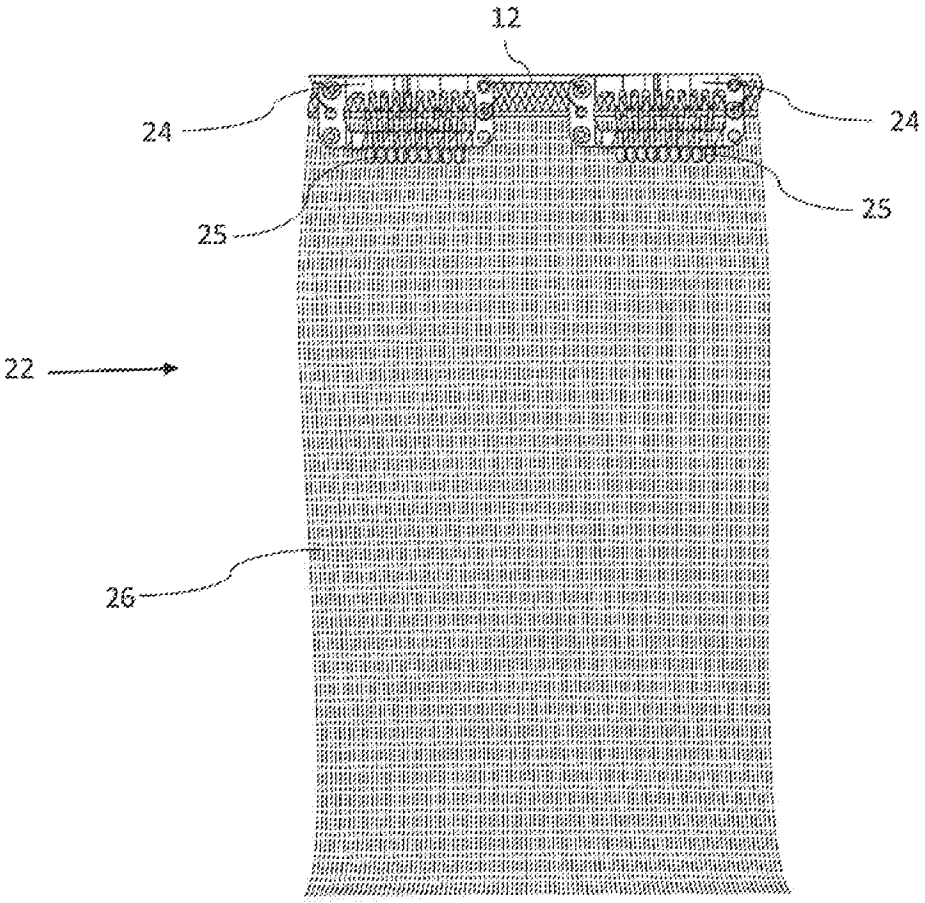
FIG. 3 is a rear view of an exemplary hair extension in accordance with the subject technology.

Referring now to FIGS. 1-3, exemplary hair extensions 22 are shown. FIGS. 1-2 are front and back perspective views, respectively, of exemplary wefts 12 and clips 24 for hair extensions 22 in accordance with the subject technology. FIG. 3 is a rear view of an exemplary hair extensions 22 in accordance with the subject technology.

The wefts 12 are typically a strip of fabric which includes strands of extension hair 26 (see FIG. 3, the extension hair 26 being shown in broken line form to better illustrate the other components of the hair extension 22). The hair 26 is attached and/or woven directly to the fabric of the weft 12. Each weft 12 includes a number of clips 24. Each clip 24 has a number of teeth 25 with can be manipulated to clip the existing hair of the user between the teeth 25 and a lower support 27 of the clip 24. This allows the weft 12 to be attached onto the existing hair of the user. The clips 24 can be sewn directly onto the fabric of the weft 12, with each weft 12 including at least a clip 24 on each end. Depending on the length of a given weft 12, additional clips 24 can be included between the end clips 24. When the weft 12 is attached to a user's hair by the clips 24, the corresponding extension hair 26 serves as an extension to supplement the hair of the user.

Figure 5:
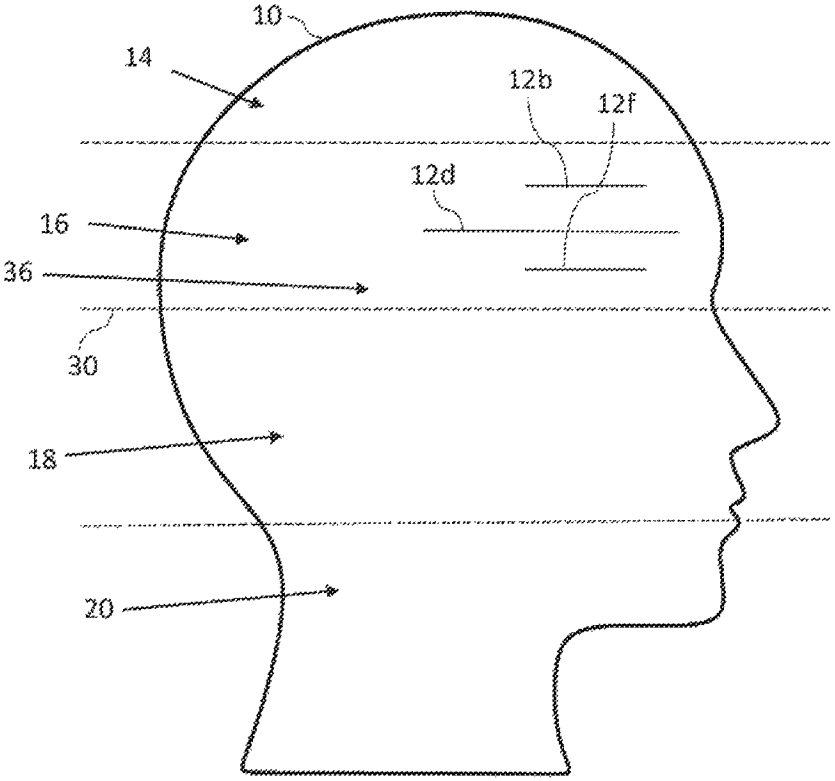
FIG. 5 is a schematic side view of a head showing exemplary weft placements for hair extensions in accordance with the subject technology.
Figure 4:
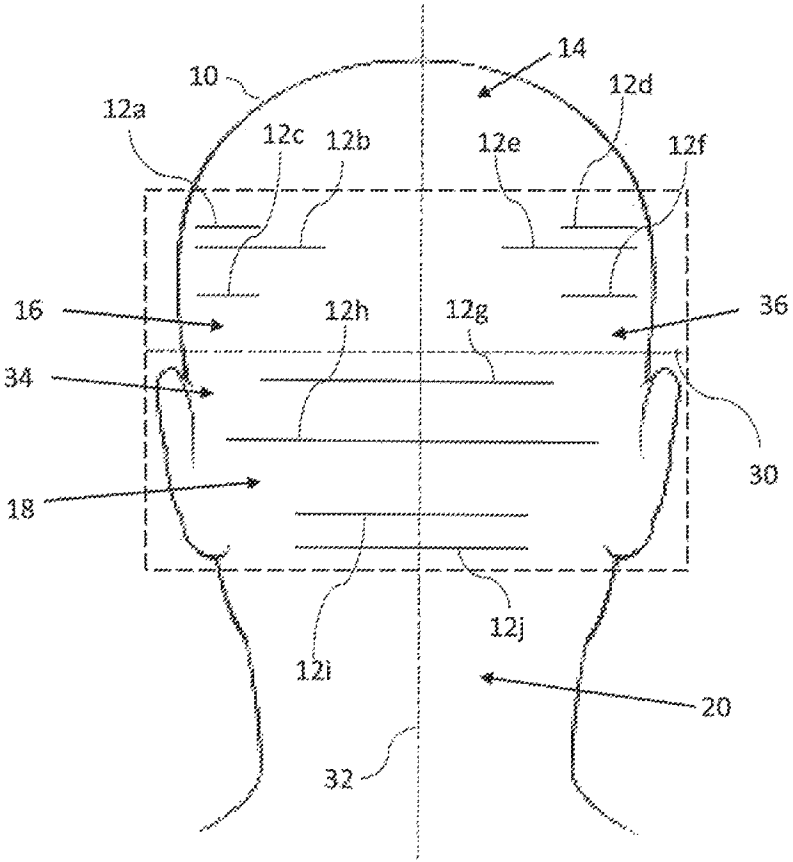
FIG. 4 is a schematic rear view of a head showing exemplary weft placements for hair extensions in accordance with the subject technology.

Referring now to FIGS. 4-5, schematic rear and side views, respectively, of a head 10 of a user with exemplary weft placements for hair extensions, in accordance with the subject technology are shown. In these figures, extension hair is omitted from the wefts 12*a*-12*j* (generally 12) for clarity. Lower wefts 12*g*-12*j* are also omitted from FIG. 5 for clarity. The wefts 12 are clipped to the user's hair at locations similar to those shown such that the wefts 12 run substantially horizontally across and/or around the user's head. As a result, the extension hair runs substantially vertically to imitate the user's hair, as discussed in more detail below (e.g. FIG. 6).

For ease of explanation as to the placement of the wefts 12 and corresponding extension hair, the head 10 can be described as divided into a number of portions or sections. Vertically, the head 10 includes a top portion 14, a bottom portion 20, an upper section 16, and a lower section 18. The top portion 14 is proximate to the uppermost, or top of the user's head 10. The bottom portion 20 is the lowermost portion of the user's head 10, proximate or adjacent to the user's neck. For reference, a vertical centerline 30 is also shown dividing the head 10 into vertical halves (i.e. the vertical centerline 30 running horizontally to divide the top and bottom of the head 10). The lower section 18 is located below the vertical centerline 30 and above the bottom portion 20, while the upper section 16 is located above the vertical centerline 30 and below the top portion 14. For reference, a horizontal centerline 32 is also shown dividing the head 10 into horizontal halves (i.e. the horizontal centerline 32 running vertically to divide the head 10 into sides 34, 36). Therefore the first side section 34 is located on a first side of the horizontal centerline 32 (visually to the left) while the second side section 36 is located on a second side 36 of the horizontal centerline 32 (visually to the right).

The wefts 12 and clips 24 are applied based upon the contour of the head and specified placement instructions. The layout of the hair extensions resulting from the particular length of the wefts and placement of the wefts on the user's head 10 results in a combination of the hair extensions and the user's natural hair that is a full and natural look. Now, the particular placement and arrangement of the wefts in accordance with the subject technology is discussed with reference to FIGS. 4-5.

With respect to weft placement, a first group of wefts 12*a*-12*c* are attached to hair in the upper section 16 on the first side 34 of the user's head 10. A second group of wefts 12*d*-12*f* are attached to hair in the upper section 16 on the second side 36 of the user's head 10. In the example given, the first group of wefts 12*a*-12*c* and the second group of wefts 12*d*-12*f* both include three wefts 12 which are substantially the same in terms of size and positioning on the user's head 10, in that the first group of wefts 12*a*-12*c* mirrors the second group of wefts 12*d*-12*f* around the horizontal centerline 32. A third group of wefts 12*g*-12*j* are attached to hair in the lower section 18. In the example shown, the third group includes four different wefts 12*g*-12*j* each centered on the horizontal centerline 32. Each of the wefts 12*g*-12*j* in the third group can include two clips, allowing each weft 12*g*-12*j* to be simultaneously clipped to hair on the first side 34 of the user's head 10 and on the second side 36 of the user's head 10.

As mentioned above, the length of the wefts 12 also affects the ultimate look of the hair extensions on the user, and therefore providing wefts 12 of preferred lengths can further the goals of the subject technology of providing a natural and full appearance. In general, it should be understood that where a weft of a given length is discussed herein, it is assumed that that weft includes extension hair extending from substantially the entire length of the weft 12. Therefore first group of wefts 12*a*-12*c* can include first and second wefts 12*a*, 12*c* of a given, shared length. By contrast, the third weft 12*b*, positioned vertically in between the first and second wefts 12, 12*c*, can be of a greater length than the first and second wefts 12*a*, 12*c*. As mentioned above, the second group of wefts 12*d*-12*f* mirror the first group 12*a*-12*c* around the horizontal centerline 32 in the example shown. Therefore the second group includes fourth and fifth wefts 12*d*, 12*f* that are the same length as the first and second wefts 12*a*, 12*c*, while the sixth weft 12*e* is the same length as the third weft 12*b*. The sixth weft 12*e* is similarly positioned vertically between the fourth and fifth wefts 12*d*, 12*f*.

In the example shown, the third group of wefts 12*g*-12*j* include wefts of three different lengths. In particular, the seventh and eighth wefts 12*i*, 12*j*, which are proximate to the bottom portion 20 as compared to the other wefts 12*g*-12*h* in the lower section 18, are of a length greater than that of the third and sixth wefts 12*b*, 12*e*. A ninth weft 12*g*, which is proximate to the vertical centerline 30 as compared to the other wefts 12*h*-12*j*, is of a length greater than that of the seventh and eighth wefts 12*i*, 12*j*. A tenth weft 12*h* is located vertically between the seventh and eighth wefts 12*i*, 12*j* on a first side and the ninth weft 12*g* on an opposing side, and is of a length greater than the ninth weft 12*g*.

While the lengths of the wefts can vary, some particular lengths have been found to be effective in achieving the goals of the subject technology. For example, in some embodiments, the first, second, fourth, and fifth wefts 12*a*, 12*c*, 12*d*, 12*f* can be of a first length of substantially 1.5 inches ("substantially" being used herein to denote a range of +/−10%). The third and sixth wefts 12*b*, 12*e* can be substantially 4 inches in length. The seventh and eighth wefts 12*i*, 12*j* can be substantially 6 inches in length. Finally the ninth weft 12*g* can be substantially 7 inches in length while the tenth weft 12*h* can be substantially 8 inches in length.

Figure 6:
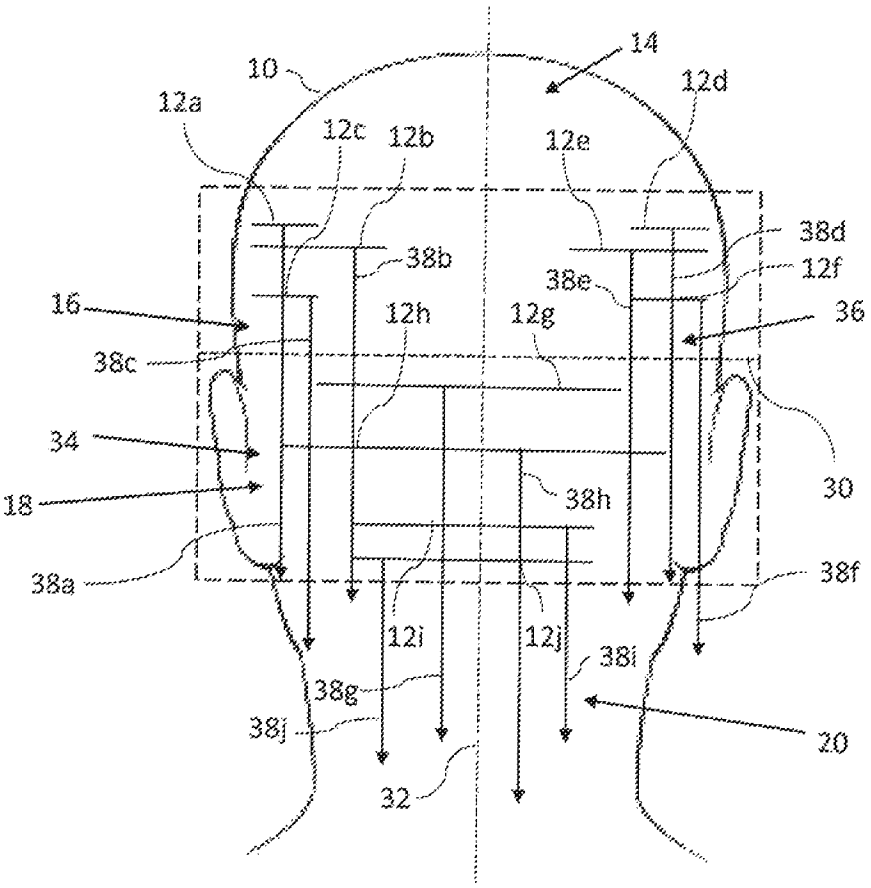
FIG. 6 is a schematic rear view of a head showing exemplary weft and hair extension placement in accordance with the subject technology.

Referring now to FIG. 6, a schematic rear views of an exemplary head 10 of a user with weft placements for hair extensions, in accordance with the subject technology is shown. FIG. 6 is similar to FIG. 4, except that the wefts 12 shown in FIG. 6 are also shown including extension hair 38*a*-38*j* (generally 38) in accordance with the subject technology. As noted above, the length of the extension hair 38 on the wefts 12 can also be varied to help accomplish the goals of the subject technology. Notably, the hair extensions 38 are represented schematically by individual lines which are not to scale and are not meant to represent the actual length of the extension hair therein. Further, it should be understood that the hair extensions 38 actually extend widthwise across the entire length of each weft 12.

In one exemplary arrangement, the first, third, fourth, sixth, and eighth wefts 12*a*, 12*b*, 12*d*, 12*e*, 12*j* can each include a respective hair extension 38*a*, 38*b*, 38*d*, 38*e*, 38*j* of a shared first length. Similarly, the second, fifth, seventh, ninth, and tenth wefts 12*c*, 12*f*, 12*i*, 12*g*, 12*h* can each include a respective hair extension 38*c*, 38*f*, 38*i*, 38*g*, 38*h* of a shared second length, the second length being greater than the first length. In some cases, the second length can be substantially two inches greater than the first length.

Referring now to FIGS. 1-6, different sized clips 24 and different numbers of teeth 25 on each clip 24 can be used with respect to certain wefts 12 to achieve desirable results. For example, the clips 24 associated with the top four wefts 12*a*, 12*b*, 12*d*, 12*e* in the upper section 16 can have a clip size of substantially 23 mm in width (i.e. from one tooth 25 to the further tooth 25 on an opposite side) and include seven teeth 25 on each clip 24. Additionally, the small wefts 12*a*, 12*d*, which can be substantially 1.5 inches in length, can include a single clip 24. The larger wefts 12*b*, 12*e*, which can be substantially four inches in length, can include three clips 24. This design is beneficial in the top of the upper section 16, since that is where the user's hair is expected to be at its finest density. Utilizing this design, which provides a relatively small clip size and minimal number of teeth 25 reduces tension on the user's hair by being as light as is practical while still maintaining a reliable grip.

In the middle section of the head, the wefts 12*c*, 12*f*, 12*g* adjacent to (i.e. on either side of) the vertical centerline 30 can include clips 24 with a clip size of substantially 28 mm and include eight teeth 25 on each clip 24. The smaller wefts 12*c*, 12*f*, which can be substantially 1.5 inches in length, can each include one clip. The larger weft 12*g*, which can be substantially 7 inches in length, can include four clips. This design is beneficial for use in the middle area of the user's head, in accordance with the wefts 12*c*, 12*f*, 12*g* which are adjacent to the vertical centerline 30, as in this central area of the user's head the density tends to be thicker than the top of the upper section 16 but finer than the bottom of the lower section 18. Utilizing this design, which provides a moderate clip size and number of teeth 25 reduces tension on the hair by both the clip and the weft being as light as possible for this area, while still adding to the overall weight and coverage with wider and stronger wefts 12*c*, 12*f*, 12*g* in this region.

In the bottom of the lower section 18, the three wefts 12*h*, 12*i*, 12*j* nearest the user's neck can include clips 24 with a clip size of substantially 33 mm and 9 teeth 25 on each clip 24. The bottom two wefts 12*i*, 12*j* in that region, which can each be substantially six inches, can each include three clips 24. The upper most weft 12*h* within that region can be substantially 8 inches and can include four clips. This design is utilized to be used at the bottom of the lower section 18 to maximize grip where the user's hair is expected to be the densest.

Therefore in one example, in accordance with the hair extension lengths described above, the first length can be substantially 14 inches and the second length can be substantially 16 inches. In another embodiment, the first length can be substantially 16 inches and the second length can be substantially 18 inches. In yet another embodiment, the first length can be substantially 18 inches and the second length can be substantially 20 inches. Notably, while these particular lengths have been found to be effective, other arrangements may use different particular lengths of hair extensions.

In addition to the length of extension hair and positioning of the hair extensions discussed herein, it can be advantageous to attach the hair extensions using a particular method and/or in a particular order. In one example, the user can first brush their hair thoroughly to ensure that it is tangle free. A tail comb can be used to part the user's hair horizontally across the back of the head, substantially 1-2 inches above where the hair line starts. The rest of the user's hair can be clipped up and out of the way. The layer of hair that is left down, and not clipped up, can be gently teased and/or back combed. This will help the clips stay in place.

The first weft to be clipped to the user's hair can then be the eighth weft 12*j*, that weft 12*j* being lowest and closest to the user's neck. In some embodiments, this weft 12*j* can include three clips 24, including two end clips and a middle clip. The weft 12*j* can be clipped in place by first clipping the middle clip to the user's hair. The user's hair is first lifted up and slightly away from their head before the middle clip is closed in place. This is then repeated for the end clips, until all clips of the weft 12*j* have been attached to the user's hair.

The user's hair can then be parted substantially one inch above the eighth weft 12*j*, and the remaining hair can be clipped up. The seventh weft 12*i* can then be attached next. Like the eighth weft 12*j*, the seventh weft 12*i* can be attached to three clips, including two end clips and a middle clip. The clips of the seventh 12*i* can then be fastened to the user's hair substantially one inch above the eighth weft 12*j*, using the same method as described with respect to the eighth weft 12*j*.

The hair substantially one inch above the eighth weft 12*j* can then be sectioned so that the tenth weft 12*h* can be attached next. The tenth weft 12*h* includes four evenly spaced clips 24, including two interior clips nearer the center of the weft 12*h* and two end clips near the exterior ends of the weft 12*h*. The clips of the tenth weft 12*h* can then be attached using the hair teasing and clipping method similarly to the clips of the eighth weft 12*j* with the two interior clips first being attached to the user's hair prior to the end clips being attached.

After the tenth weft 12*h* is attached, the rest of the user's hair can be clipped up and out of the way for attachment of the ninth weft 12*g*. The ninth weft 12*g* includes four evenly spaced clips 24 similar to the clips of the tenth weft 12*h*, including two interior clips and two end clips. Likewise, the ninth weft 12*g* can be attached using the hair teasing and clipping method similar to that of the tenth weft 12*j*. The user's hair that was clipped up can then be released down. The combination of the user's hair and the extension hair attached to the wefts can then be gently brushed through all layers to blend out the color and ensure there are no knots.

The wefts 12*a*-12*f* in the upper section 16 can then be attached. Notably, it should be understood that for the attachment of each individual weft, the methods described above of brushing, teasing, and lifting hair to attach the weft clips can be utilized, so further discussion of these methods will be omitted. Within the upper section 16, it doesn't matter whether the weft 12*a*-12*c* in the first group or the wefts 12*d*-12*f* are attached next. However, within each group, it is beneficial to attach the wefts starting from the lowest weft (nearest the neck) and moving to the highest weft (nearest the top of the head). So for example, when the first group of wefts 12*a*-12*c* is attached, it can be advantageous to start by first attaching the second weft 12*c*. Prior to attaching the second weft 12*c*, hair is parted about one inch above the ear on the first side section 34. The rest of the hair is clipped up and out of the way. The second weft 12*c* can then be clipped to the hair roughly one inch above the ear. In some cases, the second weft 12*c* includes only a single clip. Next, the third wet 12*b* can be attached. The third weft 12*b* can include end clips and a middle clip. The third wet 12*b* can be clipped into the hair above the second weft 12*c* within the first side section 34. The user's hair can then be parted substantially one inch above the third weft 12*b* and the remaining hair can be clipped up and out of the way. The first weft 12*a* can then be attached. Like the second weft 12*b*, the first wet 12*a* can include a single clip in some cases. The clip of the first weft 12*a* can then be attached substantially one inch above the third weft 12*b*. The other hair that was clipped out of the way for attachment of the wefts can then be released. The combination of the user's hair and the extension hair attached to the wefts can then be gently brushed through all layers to blend out the color and ensure there are no knots.

Notably, the wefts of the second group 12*d*-12*f*, can be attached in a similar order and manner as described above with the wefts of the first group 12*a*-12*c*. In particular, attachment of the fifth we 12*f* mirrors attachment of the second weft 12*b*, attachment of the sixth weft 12*e* mirrors attachment of the third weft 12*b*, and attachment of the fourth weft 12*d* mirrors attachment of the first weft 12*a*. Once both the first group 12*a*-12*c* and the second group 12*d*-12*f* have been attached, all wefts 12 (and therefore all hair extensions) will be fixed to the user's head in accordance with the subject technology.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A method of attaching hair extensions to hair on a user's head, the head having a plurality of vertical sections including: a bottom portion proximate to the user's neck; a top portion proximate to a top of the user's head; a lower section between the bottom portion and a vertical centerline of the user's head; and an upper section between the vertical centerline and the top portion, the head further having a plurality of horizontal sections including: a first side section on a first side of a horizontal centerline; and a second side section on a second side of the horizontal centerline opposite from the first side, the method comprising:

attaching a first plurality of wefts to hair in the upper section on the first side;

attaching a second plurality of wefts to hair in the upper section on the second side; and attaching a third plurality of wefts to hair, each of the third plurality of wefts being attached to hair in the lower section on the first side and attached to hair in the lower section on the second side, wherein:

each of the wefts include at least one clip configured to attach the wefts to hair, the method comprises attaching the wefts to hair on the user's head using the clips; and the clips included with the first plurality of wefts and second plurality of wefts have a first size and the clips included with the third plurality of wefts have a second size, the first size being less than the second size.

2. The method of claim 1, wherein the second plurality of wefts are of the same length as the first plurality of wefts.

3. The method of claim 2, wherein the second plurality of wefts mirror the first plurality of wefts around the horizontal centerline.

4. The method of claim 1, wherein the third plurality of wefts are centered on the horizontal centerline.

5. A method of attaching hair extensions to hair on a user's head, the head having a plurality of vertical sections including: a bottom portion proximate to the user's neck; a top portion proximate to a top of the user's head; a lower section between the bottom portion and a vertical centerline of the user's head; and an upper section between the vertical centerline and the top portion, the head further having a plurality of horizontal sections including: a first side section on a first side of a horizontal centerline; and a second side section on a second side of the horizontal centerline opposite from the first side, the method comprising:

attaching a first plurality of wefts to hair in the upper section on the first side, the first plurality of wefts including first and second wefts of a first length and a third weft of a second length greater than the first length, the third weft being positioned vertically in between the first and second wefts;

attaching a second plurality of wefts to hair in the upper section on the second side, the second plurality of wefts including fourth and fifth wefts of the first length and a sixth weft of the second length, the sixth weft being positioned vertically in between the fourth and fifth wefts, the second plurality of wefts being attached to hair to mirror the first plurality of wefts about the horizontal centerline; and attaching a third plurality of wefts to hair such that the third plurality of wefts are centered around the horizontal centerline, each of the third plurality of wefts being attached to hair in the lower section on the first side and attached to hair in the lower section on the second side, the third plurality of wefts including: seventh and eighth wefts proximate to the bottom portion with respect to the other wefts and having a third length greater than the second length; a ninth weft proximate to the vertical centerline and having a fourth length greater than the third length; and a tenth weft having a fifth length greater than the fourth length and located vertically between the wefts of the third length and the fourth length, wherein:

each of the wefts each comprise an extension of hair;

the first length is substantially 1.5 inches;

the second length is substantially 4 inches;

the third length is substantially 6 inches;

the fourth length is substantially 7 inches; and the fifth length is substantially 8 inches, the first weft is positioned vertically above the third weft and second weft is positioned vertically below the third weft;

the fourth weft is positioned vertically above the sixth weft and the fifth weft is positioned vertically below the sixth weft;

the first weft and the fourth weft each include one clip of substantially 23 mm in width and having seven teeth each;

the third weft and sixth weft each include three clips of substantially 23 mm in width and having seven teeth each;

the ninth weft is positioned vertically above the seventh weft;

the second weft and the fifth weft each include one clip of substantially 28 mm in width and having eight teeth each;

the ninth weft includes four clips of substantially 28 mm in width and having eight teeth each;

the tenth weft includes four clips of substantially 33 mm in width and having nine teeth each;

the seventh weft and eighth weft each include three clips of substantially 33 mm in width and having nine teeth each; and wherein the clips are configured to attach the wefts to hair on the user's head.

6. The method of claim 5, wherein:

the first weft, the third weft, the fourth weft, the sixth weft, and the eighth weft each include an extension of hair of a sixth length; and the second weft, the fifth weft, the seventh weft, the ninth weft, and the tenth weft each include an extension of hair of a seventh length, the seventh length being greater than the sixth length.

7. The method of claim 6, wherein the seventh length is substantially 2 inches greater than the sixth length.

8. The method of claim 7, wherein:

the sixth length is substantially 14 inches; and the seventh length is substantially 16 inches.

9. The method of claim 7, wherein:

the sixth length is substantially 16 inches; and the seventh length is substantially 18 inches.

10. The method of claim 7, wherein:

the sixth length is substantially 18 inches; and the seventh length is substantially 20 inches.

11. The method of claim 5, wherein the third plurality of wefts is attached prior to attaching the first plurality of wefts or the second plurality of wefts.

12. The method of claim 11, wherein the eighth weft is attached below the seventh weft and the third plurality of wefts are attached in the following order: eighth weft; seventh weft; tenth weft; ninth weft.

13. The method of claim 12, wherein the second weft is attached below the first weft and the first plurality of wefts are attached in the following order: second weft; third weft; first weft.

14. The method of claim 13, wherein the fifth weft is attached below the fourth weft and the second plurality of wefts are attached in the following order: fifth weft; sixth weft; fourth weft.

* * * * *